United States Patent [19]

Katoh et al.

[11] 4,342,429

[45] Aug. 3, 1982

[54] BOBBIN HOLDER

[75] Inventors: Takashi Katoh, Toyota; Toshio Yoshizawa, Chiryu, both of Japan

[73] Assignee: Kabushiki Kaisha Toyoda Jidoshokki Seisakusho, Aichi, Japan

[21] Appl. No.: 118,918

[22] Filed: Feb. 6, 1980

[30] Foreign Application Priority Data

Feb. 16, 1979 [JP] Japan ..... 54-19242

[51] Int. Cl.[3] ..... B65H 54/42; B65H 54/52

[52] U.S. Cl. ..... 242/18 DD; 188/266; 242/18 B; 242/65

[58] Field of Search ..... 242/18 DD, 18 B, 65; 188/266, 285, 297, 299, 308, 309, 321, 314

[56] References Cited

U.S. PATENT DOCUMENTS

| | | | |
|---|---|---|---|
| 2,677,506 | 5/1954 | Moos | 242/18 B |
| 3,016,205 | 1/1962 | Barnes, Jr. | 242/18 DD |
| 3,299,990 | 1/1967 | Ratcliffe | 242/18 DD X |

FOREIGN PATENT DOCUMENTS

| | | | |
|---|---|---|---|
| 546402 | 4/1956 | Belgium | 242/18 DD |
| 848475 | 9/1952 | Fed. Rep. of Germany | 242/18 B |
| 27116 | 12/1968 | Fed. Rep. of Germany | 242/18 DD |
| 530811 | 12/1940 | United Kingdom | 242/18 DD |
| 677359 | 8/1952 | United Kingdom | 242/18 DD |

*Primary Examiner*—Stanley N. Gilreath

*Attorney, Agent, or Firm*—Burgess, Ryan and Wayne

[57] ABSTRACT

An improved bobbin holder utilized for each winding unit of a textile machine such as an open-end spinning frame or an automatic winder. To eliminate the undesirable influence caused by the possible shock or vibration imparted to the cradle arms of the bobbin holder during the yarn package forming operation, a damping device is disposed at a position between one of the cradle arms and a stationary part of the machine frame in such condition that a free end portion of the damper is connected to the cradle arm at least during the normal operation for forming a yarn package, and a mechanism for releasing the damping operation by the damping device is provided in the bobbin holder.

5 Claims, 8 Drawing Figures

BOBBIN HOLDER

SUMMARY OF THE INVENTION

The present invention relates to an improved bobbin holder utilized for each winding unit of a textile machine such as an open-end spinning frame or an automatic winder.

When a yarn package is formed on a bobbin rotatably mounted on a pair of cradle arms of a conventional bobbin holder, since it is impossible to prevent shock or vibration being imparted to the cradle arms or a winding package of yarn during the winding operation, the possibility of formation on a bobbin of a yarn package having an incorrect shape can not be eliminated.

Regarding the above-mentioned bobbin holder, several improvements, such as the bobbin holder disclosed by the Japanese patent Laid-open publication sho 53(1978)-41253, have been proposed. However, based on research, the inventors of the present invention have formed the opinion that the above-mentioned problem still exists in the known bobbin holders.

The purpose of the present invention is to provide an improved bobbin holder wherein the influence of the above-mention shock or vibration upon the formation of the yarn package on a bobbin can be effectively eliminated so that a yarn package having proper shape can be formed on a bobbin, and the yarn piecing operation at the time of yarn breakage during the winding operation or at the time of carrying out the doffing and donning operations can be carried out promptly and easily.

To attain the purpose of the present invention, in an improved bobbin holder comprising a bracket for supporting a pair of cradle arms turnably mounted on the bracket secured to a machine frame, a damping means for absorbing shock or vibration imparted to the cradle is disposed so that a yarn package having a proper shape can be formed on a bobbin rotatably mounted on the cradle arms.

DETAILED EXPLANATION OF THE INVENTION

Figure 1:
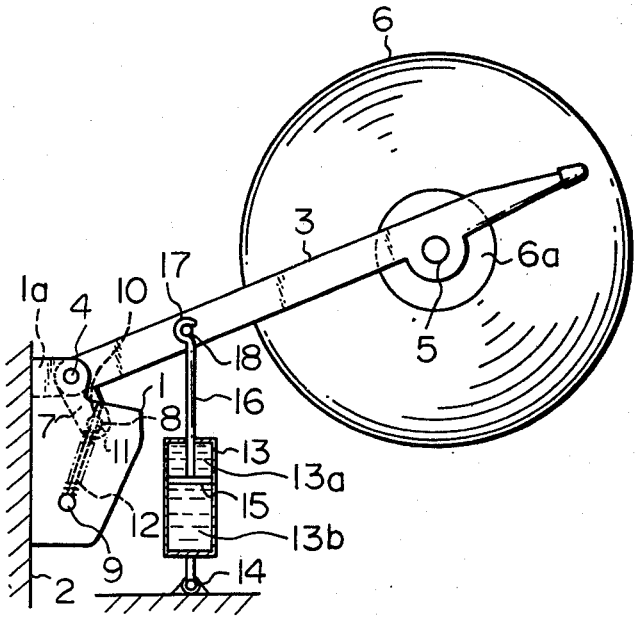
FIG. 1 is a schematic side view of one embodiment of the bobbin holder according to the present invention.

In a first embodiment of the bobbin holder of the present invention, which is shown in FIG. 1, a bracket 1 is rigidily secured to a machine frame 2, a pair of cradle arms 3 (only one shown) is rigidly mounted on a supporting shaft 4 turnably held by a top portion 1*a* of the bracket 1, a bobbin 6*a* is rotatably mounted on a pair of bobbin holding bearings 5 (only one shown) of the respective cradle arms 3 so as to form a yarn package 6 thereon. Means for controlling the contacting pressure of the bobbin 6*a* or a winding package of yarn which has been formed on the bobbin 6*a* with a friction drum (not shown) comprising an adjusting mechanism applied to either one of the cradle arm is further mounted on the above-mentioned bobbin holder. The adjusting mechanism comprises: a guide rod 10 with one end secured to a bottom pin 9 turnably mounted on the bracket 1 and the other free end portion slidably passing through a guide aperture 11 formed in a top pin 8, which is turnably mounted on a free end portion 7 branched from the cradle arm 3, and; a helical spring 12 mounted on the guide rod 10 in such condition that the top end of the spring 12 is always in contact with the top pin 8 while the bottom end of the spring 12 is always in contact with the bottom pin 9. Since the function of the above-mentioned adjusting mechanism is well known the detailed explanation thereof is omitted. However, it should be noted that other types of adjusting mechanisms may be used, for example, a mechanism utilizing oil or a pneumatic cylinder, may be used.

When the above-mentioned control means is utilized for the bobbin holder, the cradle arms 3 are gradually turned in the counter clockwise direction in FIG. 1, while bearing the spring force of the springs 12, as the diameter of the yarn package 6 increases. However, if there is not provided with any particular auxiliary means in the bobbin holder, as already mentioned, undesirable shock or vibration may be imparted to the yarn package 6 and/or the cradle arms 3 during the above-mentioned operation of forming the yarn package 6.

To eliminate the undesirable influence of the above-mentioned shock or vibration imparted to the yarn package 6 and/or the cradle arms 3, in this embodiment, an oil damper applied to either one of the cradle arms for absorbing shock or vibration is utilized for the bobbin holder. This oil damper comprises: an oil cylinder 13 turnably mounted on the machine frame 2 in such a condition that the cylinder 13 is capable of turning about a supporting shaft 14 rigidly mounted on the machine frame 2; a piston 15 with an orifice (not shown) formed therein; which allows a flow of oil between a chamber 13*a* and a chamber 13*b* separated by the piston 15; a piston rod 16 provided with a hook shaped free end 17 which is capable of engaging with a pin 18 rigidly disposed on one of the cradle arms 3. In this embodiment, the above-mentioned oil damper is disposed so that it is associated with the cradle arm 3 related to the above-mentioned adjusting mechanism. Therefore, when the hook shaped free end 17 is engaged with the pin 18 during the operation of forming the yarn package 6, since the piston rod 16 is provided with a resistance created by a flow-resistance of the above-mentioned orifice, the possible any shock or vibration imparted to the cradle arms 3 can be effectively absorbed by the above-mentioned damping means.

When it is required to carry out the yarn piecing operation or threading operation at the time of a yarn breakage or a doffing and donning operation, respectively, the cradle arms 3 are turned in the clockwise direction (in FIG. 1) to carry out the above-mentioned operation. In such a case, the cylinder 13 is first turned in the counter clockwise direction (in FIG. 1) about the pin 14, so that the hook shaped free end 17 of the piston rod 16 is disengaged from the pin 18 of the cradle arm 3. As a result, the cradle arms 3 directly or indirectly receive the action of the spring 12 of the adjusting mechanism applied to one of the cradle arms and consequently, the downward turning motion of the cradle arms 3 toward the respective positions thereof to carry out the above-mentioned yarn piecing or threading operation can be carried out quickly and easily.

Figure 2:
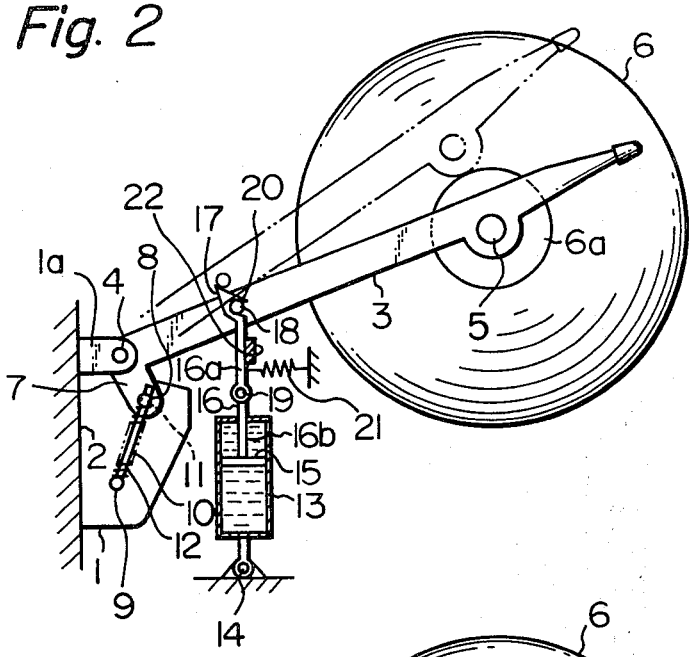
FIGS. 2 and 3 are schematic side views of other embodiments of the bobbin holder according to the present invention.

In a second embodiment of the bobbin holder according to the present invention, which is shown in FIG. 2, which is a modification of the above-mentioned first embodiment, the piston rod 16 is divided into two portions 16*a* and 16*b* which are connected by a connecting pin 19. The hook end portion 17 is formed at the top free end of the portion 16*a*, and the top surface of the hook end portion 17 works as a cam surface having a slope 20 inclined toward the opening of the hook end portion 17. A helical spring 21 is disposed at a position between the portion 16*a* of the piston rod 16 and the machine frame 2 so as to always pull the upper portion 16*a* of the piston rod 16 toward the direction for engaging the hook end portion 17 with the pin 18. A stopper 22 is disposed on the machine frame so as to restrict the turning motion of the top portion 16*a* of the piston 16 at a predetermined position.

With this second embodiment, after carrying out a doffing and donning operation or a yarn piecing operation, during which the hook end portion 17 of the piston rod 16 is disengaged from the pin 18, when it is required to engage the hook end portion 17 with the pin 18, the cradle arms 3 are turned in the clockwise direction (in FIG. 2) toward a friction roller (not shown), so that the pin 18 of the cradle arm 3 is forced to contact the top surface of the slope 20, and the top portion 16*a* of the piston rod 16 is forced to turn toward the counter clockwise direction (in FIG. 2) about the connecting pin 19 by the downward pushing force of the pin 18 which is created by a further clockwise direction turning motion of the cradle arm 3. Finally, when the pin 18 passes over the free end of the slope 20, since the spring 21 always pulls the top end portion 16*a* so as to turn the top end portion 16*a* in the clockwise direction, the pin 18 is forced to come into the opening of the hook end portion, in other words, the pin 18 is forced to engage with the hook end portion 17, and the clockwise turning motion of the portion 16*a* is stopped by the stopper 22. Therefore, the above-mentioned engaging condition of the pin 18 with the hook end portion 17 of the piston pin 16 is stably maintained at the position restricted by the stopper 22.

As will be understood from the above description, in the second embodiment, the operation for engaging the pin 18 with the hook end portion 17 of the piston rod 16 can be carried out easier than in the first embodiment.

Figure 3:
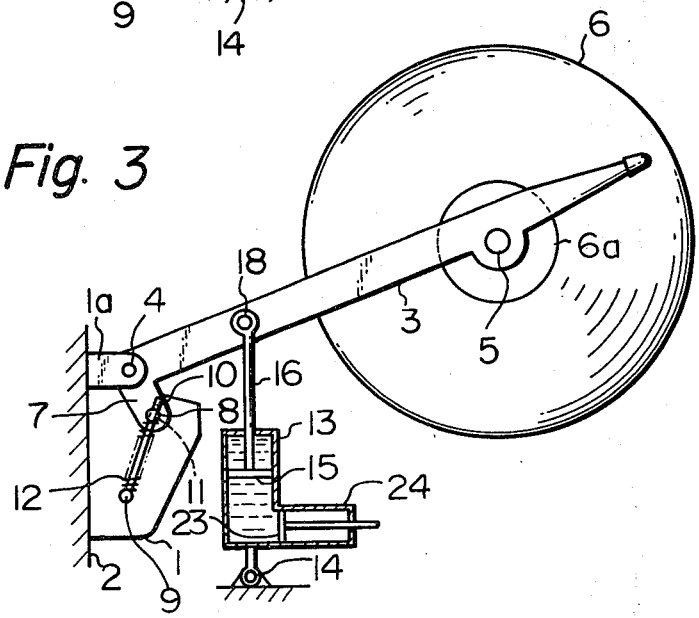

In a third embodiment of the bobbin holder according to the present invention, which is shown in FIG. 3, the mechanism of the oil damper is different from the above-mentioned first and second embodiments. As shown in FIG. 3, the oil cylinder 13 is connected to an auxiliary oil cylinder 24, which is connected to the bottom chamber 13*b* by way of an auxiliary piston 23. Therefore, when it is required to free the cradle arm 3 from the oil damper, the auxiliary piston 23 is retreated so as to increase the receiving capacity of the bottom chamber 13*b*, in other words so as to receive the oil contained in the cylinder 13 in the auxiliary cylinder 24. Consequently, the damping force created by the oil cylinder 13 is remarkably reduced, and the piston 15 and the piston rod 16 are able to move freely. In this embodiment, the top end portion of the piston rod 16 is turnably held by the pin 18 and, therefore, the above-mentioned engagement and disengagement of the piston rod 16 with the pin 18 explained in the first and second embodiments is rather complicated compared with the third embodiment, so as to release the restriction of the cradle arm by the damping means.

Figure 4A:
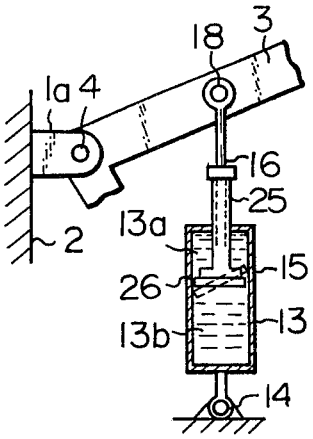
FIG. 4A is a schematic side view of a further embodiment of the bobbin holder according to the present invention.
Figure 4B:
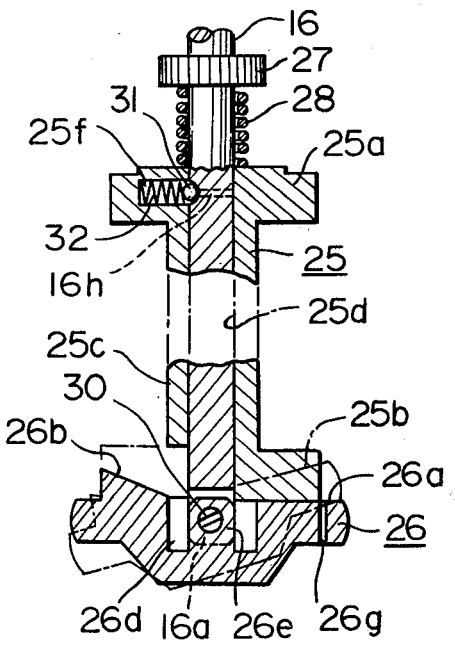
FIG. 4B is a cross-sectional side view of an actuation mechanism of a damping means shown in FIG. 4A.
Figure 4C:
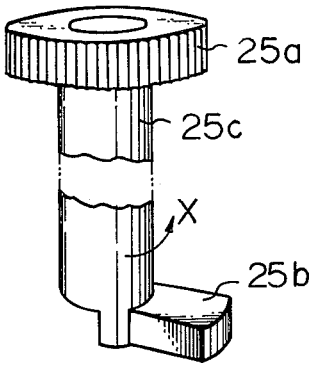
FIG. 4C is a schematic perspective view of a sheath member utilized for the damping means shown in FIG. 4A.
Figure 4D:
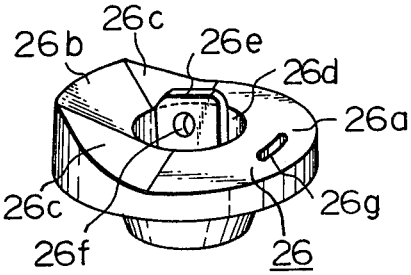
FIG. 4D is a perspective view of the piston shown in FIG. 4C.
Figure 4E:
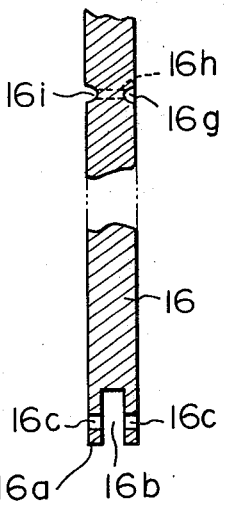
FIG. 4E is a cross sectional view of the piston rod utilized for the damping means shown in FIG. 4A.

In the fourth embodiment of the bobbin holder according to the present invention, which is a modification of the third embodiment, a releasing mechanism other than the auxiliary cylinder 24 is utilized. Referring to FIGS. 4A, 4B, 4C, 4D and 4E, the releasing mechanism comprises: a sheath member 25 provided with a top flange portion 25*a*, a bottom laterally projected portion 25*b*, and an intermediate cylindrical portion 25*c* connecting the top flange portion 25*a* and the bottom laterally projected portion 25*b*; a piston rod 16 passing through a central longitudinal aperture 25*d* of the sheath member 25; a piston 26 turnably mounted on a bottom end portion of the piston rod 16 by a pin 30; a stopper 27 secured to the piston rod 16 at a position above the top flange portion 25*a* of the sheath member 25, and a helical spring 28 mounted on the piston rod 16 at a position between the stopper 27 and the top flange portion 25*a* of the sheath member 25. The piston 26 is provided with a cam surface formed on the top surface thereof, which consists of a horizontally flat portion 26*a*, an upwardly projected portion 26*b*, a pair of intermediate sloped portions connecting the upwardly projected portion 26*b* and the two ends of the flat portion 26*a*, a central recess 26*d* and a vertical projection 26*e* projected upward from the central recess 26*d* as shown in FIG. 4D. The projection 26*e* is provided with an aperture 26*f* wherein an engaging pin 30 can be rotatably inserted so that the piston 26 is capable of turning about the engaging pin 30. As shown in FIG. 4E, the piston rod 16 is provided with a bottom end portion 16*a* having a central groove 16*b*, which is capable of receiving the above-mentioned vertical projection 26*e* of the piston 26, and with a pair of coaxially formed lateral apertures 16*c*. When the piston 26 is assembled with the piston rod 16 and the sheath member 25, the vertical projection 26*e* of the piston 26 is inserted into the central groove 16*b* and the pin 30 is inserted into the lateral apertures 16*c* of the piston rod 16 and the aperture 26*f*. In this assembled condition, since the spring 28 urges the sheath member 25 toward the piston 26, the laterally projected portion 25*b* of the sheath member 25 is always pressed to the cam surface of the piston 26. During the normal winding operation, the contacting condition of the projected portion 25*b* with the cam surface of the piston 26 is maintained in the condition shown in FIG. 4B. In this condition the projected portion 25*b* contacts the flat portion 26*a* of the cam surface of the piston 26. To stably maintain such condition, a stopper mechanism, which is hereinafter explained, is utilized. That is, as shown in FIG. 4B, the top flange portion 25*a* of the sheath member 25 is provided with a recess 25*f* opened inside, and the piston rod 16 is provided with a ring shaped groove 16*h* at a position facing the recess 25*f*. A pair of half sperical recesses 16*i* and 16*g* for receiving a ball 31 are formed at positions on the groove 16*h*. These recesses 16*i*, 16*g* are formed at symmetrical positions with respect to the longitudinal axis of the piston rod 16. The ball 31 is inserted into the recess 25*f* while an expansion spring 32 is inserted into the recess 25*f* so that it will engage with the spherical recess 16*i* of the piston rod 16. Therefore, the above-mentioned contacting condition between the lateral projected portion 25*b* of the sheath member 25 and the flat portion 26*a* of the cam surface of the piston 26 can be stably maintained.

However, when the top flange portion 25*a* is manually turned about the piston rod 16 for 180°, the ball 31 is positioned into the recess 16*g*. In this condition, the laterally projected portion 25*b* is placed on the upwardly projected surface portion 26*b* of the cam surface of the piston 26, and the piston 26 is turned in the counter clockwise direction in FIG. 4B and occupies the position represented by the broken line in FIG. 4B. Therefore, free spaces are formed between the cylinder 13 and the piston 26 so that the damping effect created by this damping device is eliminated the cradle arms 3 can be operated freely. In this embodiment, an orifice 26*g* is formed in the piston 26, as shown in FIGS. 4B and 4D, and therefore, during the normal winding operation, the damping means of this embodiment works in a manner similar to that of the first embodiment.

As a modification of the fourth embodiment, the construction of the piston rod 16 may be changed to the piston rod 16 of the above-mentioned second embodiment.

As explained hereinbefore, in the present invention, a damping device is disposed at a position between the cradle arm and a part of the machine frame, so as to eliminate the undesirable influence on the yarn package forming operation caused by shock or vibration imparted to the cradle and/or the bobbin or forming-yarn-package, and a means for releasing the action of the damping device is utilized for creating a condition in which yarn piecing and doffing operations can be easily and quickly carried out. Accordingly, the utilization of the damping device remarkably improves the function of the bobbin holder utilized for each winding unit of a textile machine, such as an open-end spinning frame or an automatic winder.

What is claimed is:

1. In a bobbin holder for a winding unit of a textile machine, wherein a pair of cradle arms are turnably supported by mounting means on the frame of the winding unit, said cradle arms rotatably supporting a bobbin on which a yarn package is formed, the improvement which comprises: a releasable damping device comprising an oil cylinder, turnably mounted on a stationary part of the machine, having a piston and a piston rod having an open hooked shaped engaging portion, a cradle arm provided with an engaging pin for releasably engaging with the hooked shaped portion of the piston rod, and wherein the hooked shaped portion of the piston rod is provided with a cam surface downwardly inclined toward the opening of the hooked shaped engaging portion against which the pin on the cradle arm rides when the hook shaped portion is disengaged from the engaging pin, a spring which urges the cam surface of the piston rod toward the engaging pin of the cradle arm and a stopper means for restricting the turning of the oil cylinder at a predetermined position corresponding to the position where said hooked shaped engaging portion engages the engaging pin.

2. In a bobbin holder for a winding unit of a textile machine, wherein a pair of cradle arms are turnably supported by a mounting means on the frame of the winding unit, said cradle arms rotatably supporting a bobbin on which a yarn package is formed, the improvement which comprises a damping device comprising a first oil cylinder, turnably mounted on a stationary part of the machine, having a piston and a piston rod which rotatably engages an engaging pin on a cradle arm, an auxiliary oil cylinder which communicates with the first oil cylinder at a point below the piston in the first oil cylinder and means in the auxiliary oil cylinder for providing an increased volume for the oil below the piston in the first oil cylinder to reduce the damping effect of the damping device.

3. An improved bobbin holder of claim 2 wherein the means in the auxiliary oil cylinder for providing an increased volume for the oil comprises an auxiliary piston in the auxiliary oil cylinder which can be operated to increase the volume for oil.

4. In a bobbin holder for a winding unit of a textile machine, wherein a pair of cradle arms are turnably supported by mounting means in the frame of the winding unit, said cradle arms rotatably supporting a bobbin on which a yarn package is formed, the improvement which comprises: a damping device comprising an oil cylinder turnably mounted on a stationary part of the machine, having a piston rod, having a longitudinal axis, which turnably engages an engaging pin on a cradle arm, a piston turnably mounted on the piston rod to turn about an axis perpendicular to the longitudinal axis of the piston rod and means for turning the piston about the axis perpendicular to the longitudinal axis of the piston rod.

5. An improved bobbin holder according to claim 1, wherein said piston rod is divided into a first portion connected to said piston and a second portion pivotably connected at one end to a free end of said first portion, and said hook shaped engaging end is formed at a free end of said second portion.

* * * * *